US006230945B1

(12) United States Patent
Licari et al.

(10) Patent No.: US 6,230,945 B1
(45) Date of Patent: May 15, 2001

(54) THROUGH-THE-NECK GARMENT HANGER

(75) Inventors: Vito Licari; Yaffa Licari, both of Somerset, NJ (US)

(73) Assignee: Basic Line, Perth Amboy, NJ (US)

( * ) Notice: Subject to any disclaimer, the term of this patent is extended or adjusted under 35 U.S.C. 154(b) by 0 days.

(21) Appl. No.: 09/454,079

(22) Filed: Dec. 3, 1999

(51) Int. Cl.[7] ..... A47G 25/14
(52) U.S. Cl. ..... 223/85; 223/DIG. 4
(58) Field of Search ..... 223/85, 89, 94, 223/92, 87, 95, DIG. 2, DIG. 4; 211/113

(56) References Cited

U.S. PATENT DOCUMENTS

| | | | | |
|---|---|---|---|---|
| D. 32,777 | * | 6/1900 | Annis | 223/85 |
| D. 76,341 | * | 9/1928 | Campbell | 223/85 |
| D. 195,018 | * | 4/1963 | McClelland | D80/8 |
| 2,122,309 | * | 6/1938 | Beimler | 223/85 |
| 2,440,636 | * | 4/1948 | Lowe | 223/94 |
| 2,440,637 | * | 4/1948 | Lowe | 223/94 |
| 2,931,547 | * | 4/1960 | Dick | 223/96 |
| 3,151,788 | * | 10/1964 | Wingate | 223/94 |
| 3,276,645 | * | 10/1966 | Buzzelli | 223/96 |
| 5,562,237 | * | 10/1996 | Saliaris | 223/96 |
| 5,649,653 | * | 7/1997 | Joseph | 223/85 |

* cited by examiner

*Primary Examiner*—Bibhu Mohanty
(74) *Attorney, Agent, or Firm*—Mathews, Collins, Shepherd & Gould P.A.

(57) ABSTRACT

A "through-the-neck" garment hanger is disclosed that may be fabricated with a single component. The hanger has a base portion, first and second slanted side portions, a neck portion, and a hook portion. One of the slanted side portions of the hanger has a free end that is not integrally attached to the rest of the hanger. Thus, a door may be formed between the slanted side portions whereby the hanger may be easily inserted through the neck of a garment.

13 Claims, 7 Drawing Sheets

THROUGH-THE-NECK GARMENT HANGER

FIELD OF THE INVENTION

The present invention relates to a hanger which can be inserted into the neck of a garment without stretching the garment. The hanger of this invention is a simple device that may be fabricated with one integral piece and yet can be used to hang a variety of garments including shirts and pants.

BACKGROUND OF THE INVENTION

There have been many attempts to make hangers that can be inserted into the neck of a garment. Such efforts have been directed toward making folding hangers. A folding hanger is advantageous in that it can be inserted when in a folded position into the neck of a sweater, dress, blouse, or the like, without having to undo any buttons or stretch the neck of the garment, and then the hanger can be unfolded to hang the garment. Folding hangers are described, for example, in the following U.S. patents: U.S. Pat. No. 5,690,257 issued Nov. 25, 1997 to Ward; U.S. Pat. No. 5,590,823 issued Jan. 7, 1997 to Lunde; U.S. Pat. No. 5,397,037 issued Mar. 14, 1995 to Ozawa; U.S. Pat. No. 4,988,021 issued Jan. 29, 1991 to Adams et al.; U.S. Pat. No. 4,730,757 issued Mar. 15, 1988 to Keller; U.S. Pat. No. 4,186,857 issued Feb. 5, 1980 to Helms, Jr.; U.S. Pat. No. 3,802,610 issued Apr. 9, 1974 to Love; U.S. Pat. No. 3,082,921 issued Mar. 26, 1963 to Sadowsky; U.S. Pat. No. 2,724,533 issued Nov. 22, 1955 to Hansen; U.S. Pat. No. 2,448,523 issued Aug. 31, 1948 to Pandele; U.S. Pat. No. D263,013 issued Feb. 16, 1982 to Angeles; and U.S. Pat. No. D202,484 issued Oct. 5, 1965 to Helms, Jr.

There are drawbacks, however, with the folding hangers described in the above-referenced patents. Many of the folding hangers involve complex designs with numerous interacting parts. The use of many parts makes it difficult to manufacture the hangers in a cost-effective manner considering, particularly, that a hanger is a low-cost item. Additionally, complicated pivoting and latching mechanisms are used in the hangers of the above-cited patents, which increase the likelihood of product failure.

A hanger which is configured to provide a simpler design is shown in U.S. Pat. No. 5,690,257 to Ward ("Ward"). Ward describes a folding hanger which consists essentially of one integral piece having two movable halves or "wings" that pivot about a connection point and snap together with use of a tongue and groove latching mechanism. The Ward hanger places both a pivot means and a latching mechanism along a vertical surface disposed between the two wings, such that each of the wings has a vertical dimension, providing a relatively bulky hanger. Also, the two wings of the Ward hanger apparently are held in place (when in an unfolded configuration), entirely by the tongue and groove latching mechanism. Thus, if ordinary wear-and-tear were to erode the strength of the latching mechanism, the effectiveness of the hanger would be destroyed.

A new simple design for a foldable hanger is disclosed in U.S. patent application Ser. No. 09/228,364, filed Jan. 11, 1999, "Folding Garment Hanger," by Yaffa Licari, an inventor herein, which is incorporated herein by reference. The '364 application shows a hanger consisting essentially of two pieces that snap-fit together. Two members are provided having elongated arm portions and a hook portion, and these members are coupled together with an extension and recess mechanism. A ringed or cupped-piece is disposed on each member; one of these pieces has a pivoting extension and another has a recess for receiving the pivoting extension whereby the two members can pivot about the piece. The hanger of the '364 patent is advantageous in that it is simpler than many of the previous configurations for folding hangers. However, it still uses interacting parts so that the hanger is more costly to make than the traditional, single-component hanger. Also, it cannot be used to hang pants because like many folding hangers, it does not have a base rod.

As may be appreciated, it would be advantageous to have a hanger that is simple in construction, sturdy, easy and inexpensive to make, and configured so that it can be inserted through the neck of a garment. New designs for hangers are desired to provide the consumer with a choice of products. The instant invention provides a "through-the-neck" configuration while avoiding the foldable feature that has generated complication in prior hanger designs. Further advantages may appear more fully upon considering the description given below.

SUMMARY OF THE INVENTION

Summarily described, the invention embraces a garment hanger that comprises one integral part and yet may be used as a "through-the-neck" hanger. The hanger comprises a rod that has a base portion, first and second slanted side portions, a neck portion, and a hook portion. The second slanted side portion of the hanger has a free end that is not integrally formed with the neck portion so that one side portion has a free end providing a door between the first and second slanted side portions. As a result, the hanger may be flexed and inserted through the neck of a garment, and a pair of slacks may be slid through the door to be hung on the base portion of the hanger. In one embodiment, the free end of the second slanted side portion of the hanger has a latch for removably attaching that slanted side portion to the neck or the first slanted side portion.

BRIEF DESCRIPTION OF THE DRAWINGS

For a better understanding of the invention, an exemplary embodiment is described below, considered together with the accompanying drawings, in which.

It is to be understood that these drawings are for the purposes of illustrating the concepts of the invention and are not to scale.

DETAILED DESCRIPTION OF THE INVENTION

Figure 1:
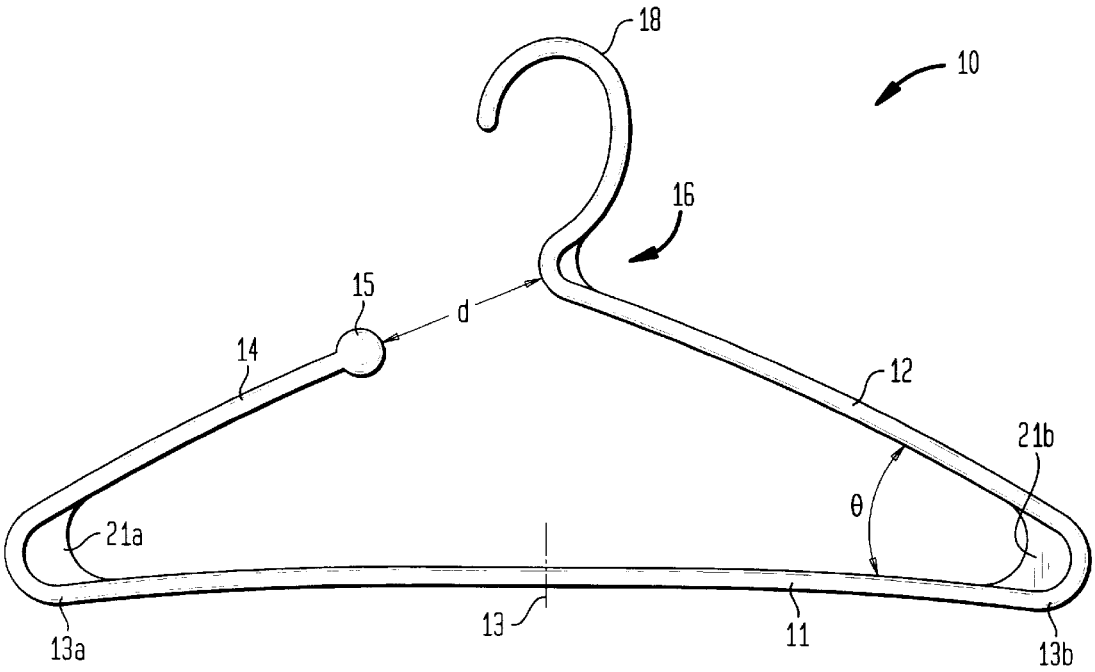
FIG. 1 illustrates a side view of one embodiment of the inventive hanger.

Referring to FIG. 1, the hanger is shown as one integral piece 10 having a base portion 11, first 12 and second 14 slanted side portions, a neck portion 16 and a hook portion 18. The garment hanger comprises a single rod piece and thus is simple and inexpensive to make. The base portion 11 has a midsection 13 and two ends 13*a*, 13*b*. A side portion extends upward from each one of the two ends 13*a*, 13*b* of the base portion and slants inward toward the midsection 13 to define the first 12 and second 14 slanted side portions. The neck portion 16 extends upward from the first slanted side portion 12, and the hook portion 18 extends upward from the neck portion. The second slanted side portion 14 has a free end 15 not integrally attached to the neck portion so that the second side portion 14 may be at least temporarily detached from the first side portion 12. In this way, an opening or door "d" is disposed between the first and second slanted side portions.

FIG. 1 shows the hanger essentially to scale. Preferably, the angle between the first side portion and the base $\phi$ is relatively small (e.g., less than 45°), so that a "squatty" hanger is provided. The smaller the angle $\phi$, the easier it will be to insert the hanger into a garment (FIGS. 7A–7B), and the sturdier the hanger will be. The hanger would work as a "through-the-neck" hanger with a large (greater than 45°) angle $\phi$, and in that case, a relatively thick rod preferably is used to provide a sturdier hanger (e.g., as compared with traditional hanger thicknesses). Thus, a small angle $\phi$ is preferred.

Also, advantageously the length of the door is sized smaller than the radius of the shirt to be hung. The larger the door, the easier it is for the hanger to be inserted into the neck of a garment, and the easier it is to slide a pair of slacks into the door to be hung on the base portion 11. However, when a shirt is allowed to remain on the hanger for some time, a large-sized door may result in the shirt collar collapsing into the door, thus wrinkling or creasing the garment. Thus, the width of the door (from the free end 15 to the neck 16) preferably is less than about 2.5 inches and preferably is about 1¾ to 2¼ inches. Further, the ends 13*a*, 13*b* and free end 15 should be rounded so that there are no sharp points that might damage a garment.

Figure 7A:
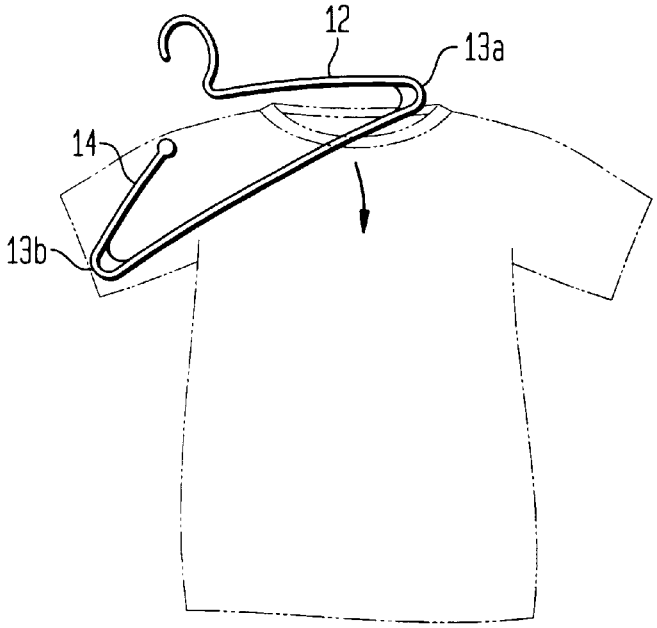
FIGS. 7A–7B show steps for inserting the hanger through the neck of a garment.
Figure 7B:
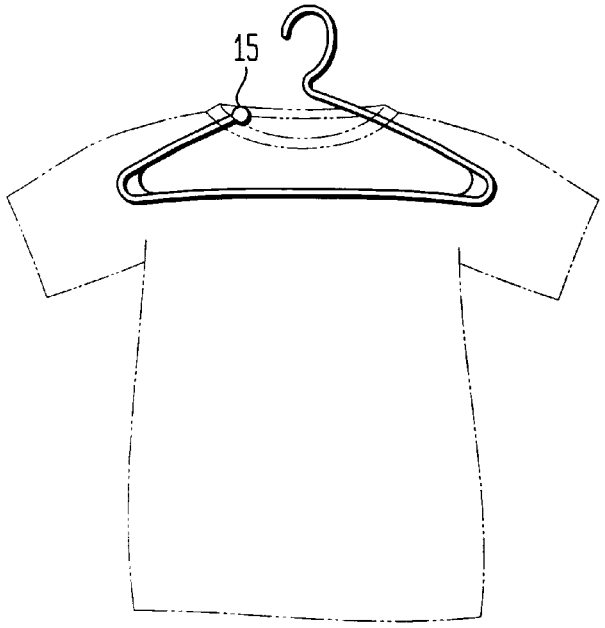
Figure 8A:
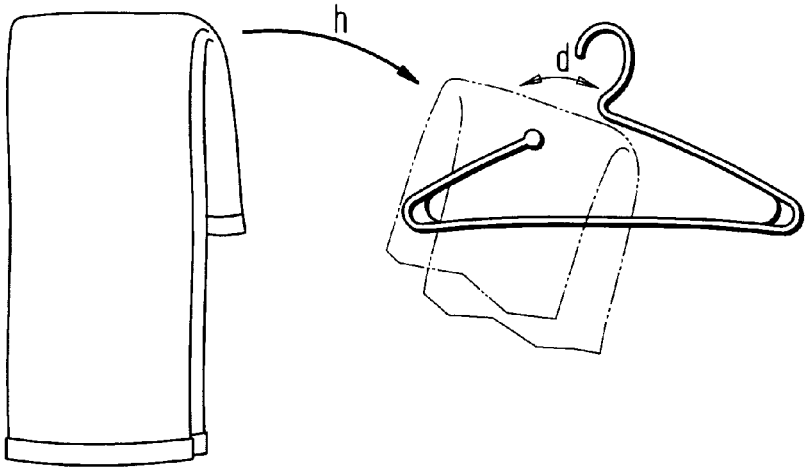
FIGS. 8A–8B show use of the hanger in hanging a pair of pants.
Figure 8B:
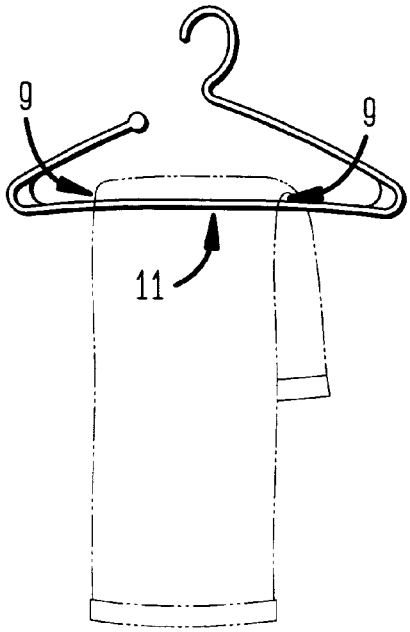

With this configuration, the hanger may be inserted through the neck of a garment as shown in FIGS. 7A–7B, and it also can be used to hang pants, as shown in FIGS. 8A–8B. Preferably, the hanger is fabricated with a material that has flexibility so that the hanger may bent or flexed, e.g., the second side portion 14 can be flexed away from the hook, neck, and first slanted side portions or downward toward the base portion, and/or the first slanted side portion 12 can be flexed upward away from the base portion 11. With this flexibility, the hanger can be stretched or compressed as it is inserted through the neck of a garment, and it can be easily flexed into a standard hanger configuration. An extension or skin piece 21*a*, 21*b*, may be used in buttressing the slanted side portions 12, 14 on the base portion 11 to provide structural support to the hanger. The skin pieces preferably extend inward from the ends 13*a*, 13*b*. Advantageously, at least the end 13*b* adjacent the first slanted side portion 12 (that does not have free end 15 or door) is has the extension 21*b*.

Advantageously, the free end 15 is rounded. The rounded free end may take on a bulbus shape as in FIG. 1, which is particularly advantageous when a wire or metal rod is used to fabricate the hanger. The bulbus free end 15 is further advantageous as it can function as a stopper to hold the collar of a shirt in place. Although in FIG. 1 the free end 15 is shown permanently detached from the neck 16, the free end also may be configured to be removably attached to the neck portion or the first slanted side portion. For example, FIGS. 2A–2B and FIG. 4A through FIG. 6 show this feature.

Figure 2A:
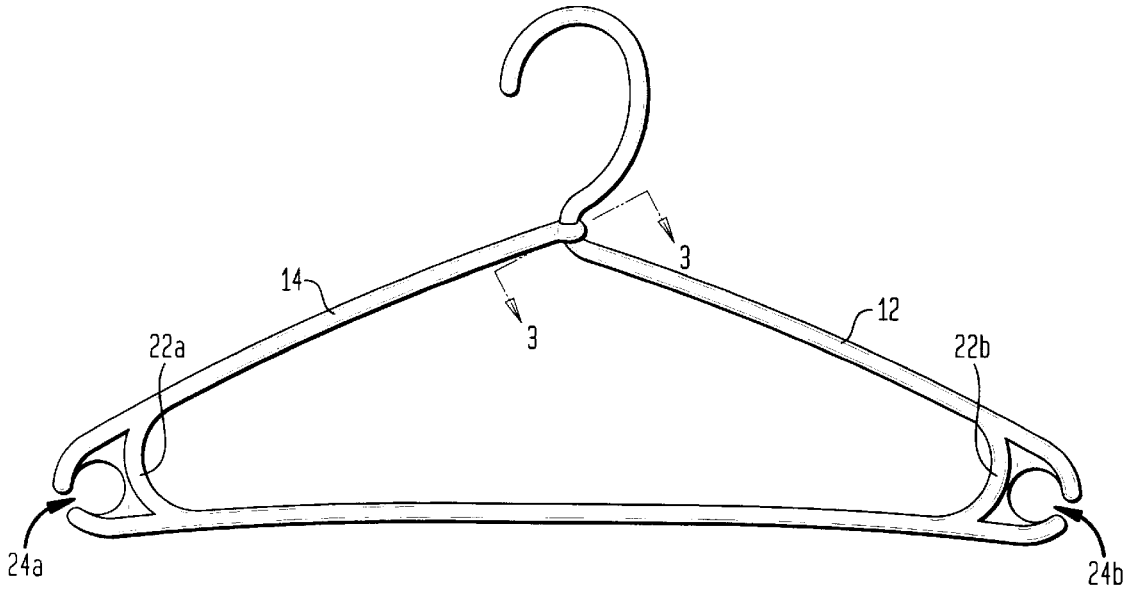
FIG. 2A illustrates a side view of an alternative embodiment of the inventive hanger in a closed configuration for hanging.
Figure 2B:
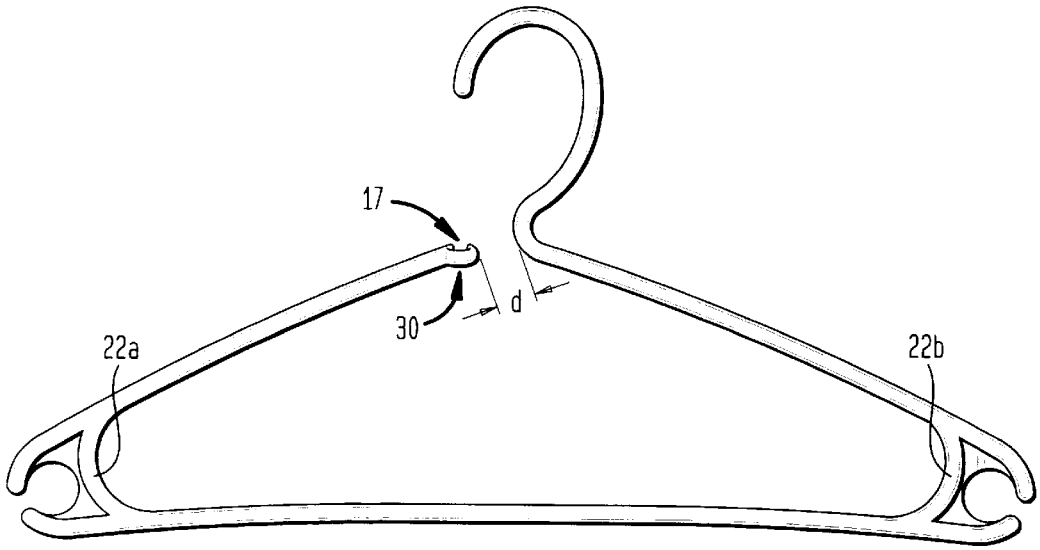
FIG. 2B shows the view of FIG. 2A in an open configuration for insertion through the neck of a garment.
Figure 3A:
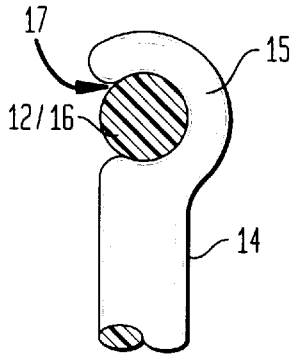
FIG. 3A shows a cross-sectional side view of the "snap-fit" mechanism of FIGS. 2A–2B through line 3—3 of FIG. 2A.
Figure 3B:
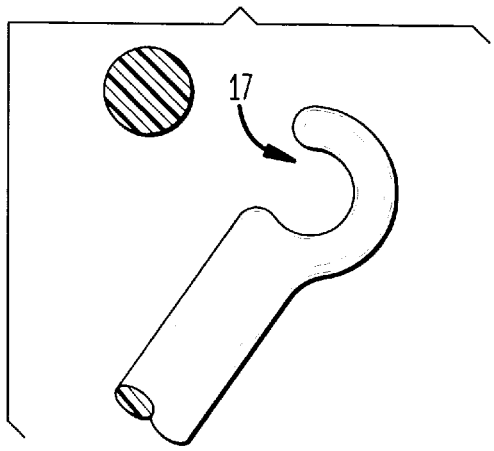
FIG. 3B shows the same view as FIG. 3A but in an open configuration.

FIG. 2A illustrates a side view of an alternative embodiment of the hanger in a closed configuration for hanging, and FIG. 2B illustrates the view of FIG. 2A in an open configuration for insertion through the neck of a garment. Here, the free end 15 has a latch 30 for closing the door "d". In this embodiment, the latch comprises a notch 17 formed at the free end having an interior that is adapted to conform substantially to the outer circumference of the neck portion 16 whereby the free end may be snap-fit over the neck portion. For example, FIG. 3A shows a cut-away cross-sectional side view of the embodiment of FIG. 2A taken along the line 3—3 of FIG. 2A. FIG. 3B shows the same view but in the open configuration, as in FIG. 2B. As can be seen, the notch 17 is adapted to conform to the circumference of the neck portion 16. Also, the interior of the notch 17 covers greater than fifty-percent of the diameter of the neck portion 16, so that the notch may "snap-fit" over the neck portion. In FIGS. 2A–2B, alternative to the extensions 21*a*, 21*b* of FIG. 1, a bridge 22*a*, 22*b* is used to connect the first and second side portions adjacent the ends 13*a*, 13*b*. The bridge is disposed inward on the base portion, e.g., toward the midsection and away from the first and second ends 13*a*, 13*b*, so that a free space 24*a*, 24*b* is created between the tips of the side portions at ends 13*a*, 13*b*. The bridge and free space configuration enhances the hanger's flexibility.

Figure 4A:
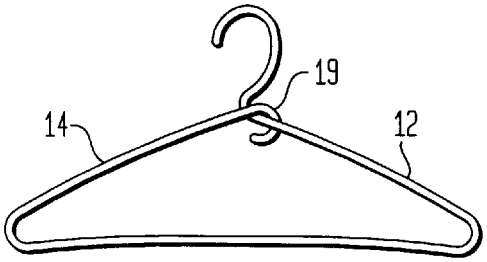
FIG. 4A illustrates a side view of an alternative embodiment of the inventive hanger in a closed configuration for hanging.
Figure 4B:
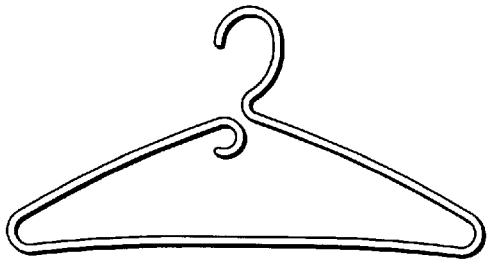
FIG. 4B shows the view of FIG. 4A in an open configuration for insertion through the neck of a garment.
Figure 5A:
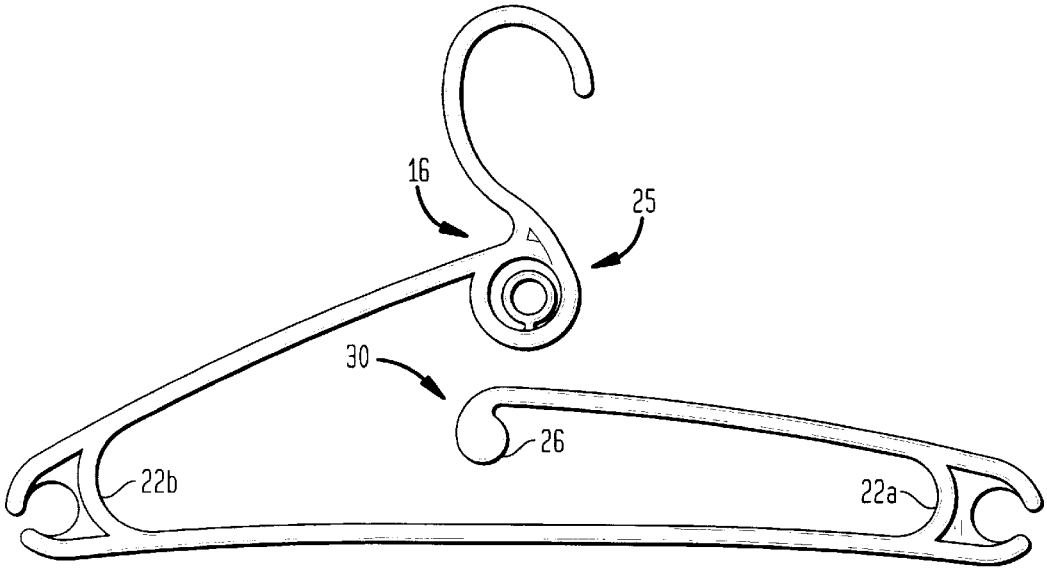
FIG. 5A illustrates a side view of an alternative embodiment of the inventive hanger in an open configuration for insertion in a garment.
Figure 5B:
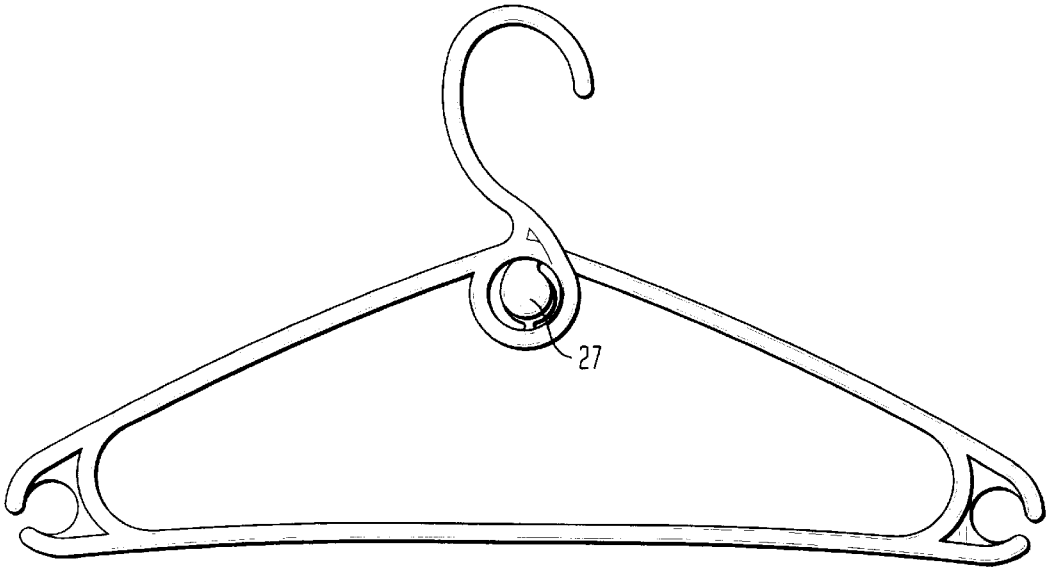
FIG. 5B shows the view of FIG. 5A in a closed configuration for hanging.
Figure 6:
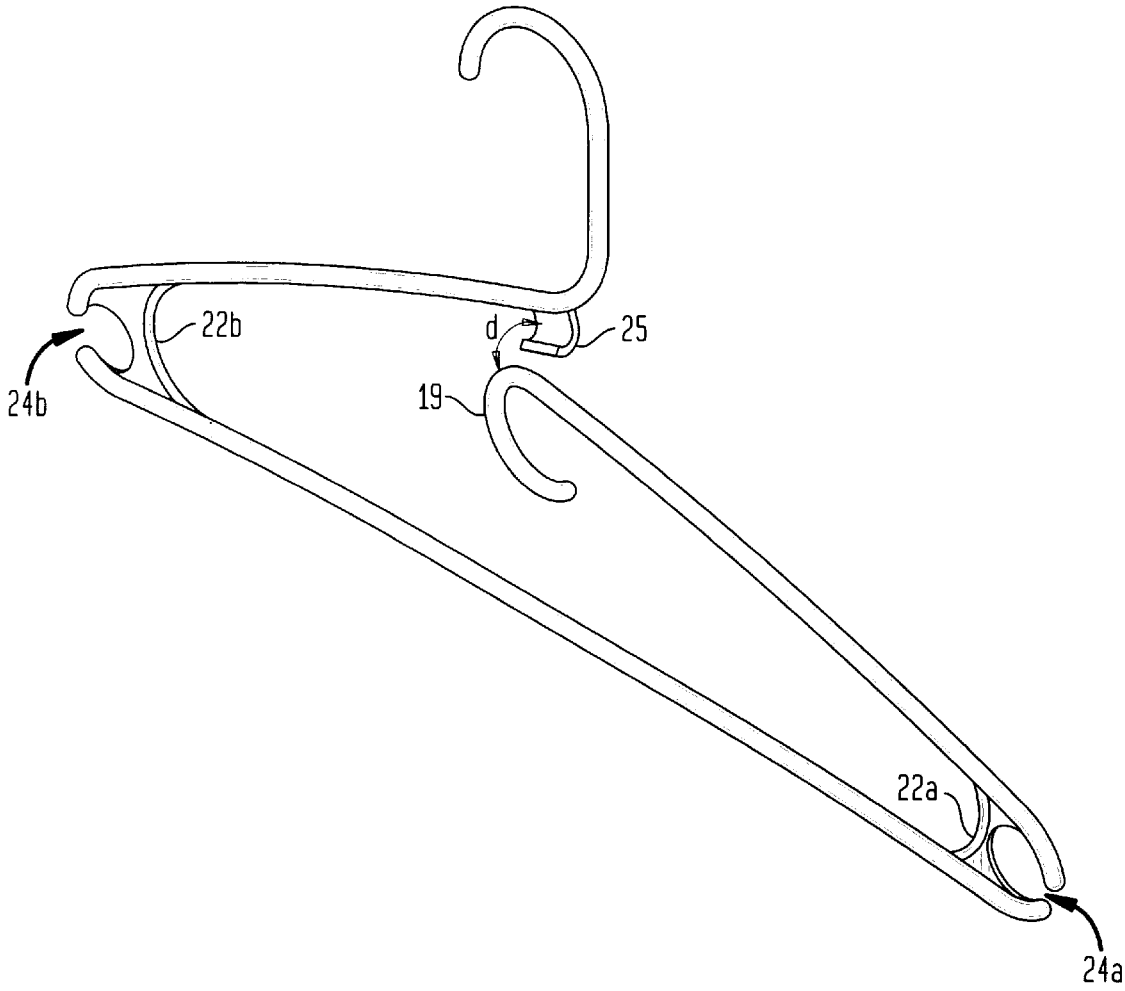
FIG. 6 illustrates an alternative embodiment of the inventive hanger in an open configuration.

FIG. 4A illustrates a side view of an alternative embodiment of the inventive hanger in a closed configuration for hanging, and FIG. 4B illustrates the view of FIG. 4A in an open configuration for insertion through the neck of a garment. Here, the latch 30 for closing the door comprises a loop 19 at the free end 15 which hooks over the neck portion or the first slanted side portion 12. One skilled in the field will appreciate that various types of latches may be used to open and close the door "d." For example, in FIGS. 5A–5B and FIG. 6, a detent mechanism 25 is used to hold the latch 30 to the neck of the hanger. In FIGS. 5A–5B, the latch comprises a flattened club piece 26 that can be seated onto a ringed piece 27 that extends downward from the neck 16. In FIG. 6, the latch is a loop 19, as in FIGS. 4A–4B, and a detent mechanism 25' is placed on the neck 16 which can catch the loop.

FIGS. 7A–7B show steps for inserting the hanger through the neck of a garment. In FIG. 7A, the second slanted side portion 14 is inserted into the garment at end 13*b*. The portion of the hanger proximal the end 13*b* may be inserted into a sleeve of the garment and then the other end 13*a* and the first slanted side portion 12 can be brought downward into the neck of the garment, following the arrow in FIG. 7A. As the hanger is placed within the garment, the first end portion 13*a* can be placed within the other sleeve so that the hanger rests within the garment as shown in FIG. 7B. When a latching mechanism is used, the free end 15 then may be snap-fit over the neck 16. As shown, the bulbus portion 15 may function as a stopper against the neck of the garment.

An advantage of this hanger is that it can be used for hanging any type of garment. The hanger provides particular benefits not only in hanging a collared shirt or other shirt with a closed neckline, but also in hanging pants, e.g., along the base portion 11. Notably, many of the folding hangers in the prior art that are configured to be inserted through the neck of the garment (e.g., while the hanger is folded), do not have the capability for hanging pants. As seen in FIGS. 8A–8B, this hanger is in fact easier to use in hanging pants than with traditional hangers. As shown in FIG. 8A, the pants when folded can simply be slid onto the base portion 11 through the door d (following the arrow "h" so that the folded pants are oriented as shown with dashed lines), and the length of the pant legs do not have to be laced through the hanger. As shown in FIG. 8B, preferably the base portion 11 is slanted or curved so that the pants do not rest flat against the base portion, e.g., a gap "g" is formed at either side of the pant leg, as hung. This helps to eliminate wrinkling of the pants.

The hanger of this invention is sturdy and can be used to hang other garments as well, including heavy jackets. Preferably, the hanger has a tubular shape and is fabricated with plastic, e.g., polyethylene, polypropylene, styrene, nylon, and copolymers, but it also could be fabricated from other flexible materials including metals.

It is understood that the embodiments described herein are merely exemplary and that a person skilled in the art may make variations and modifications without departing from the spirit and scope of the invention. All such variations and modifications are intended to be included within the scope of the appended claims.

We claim:

1. A garment hanger comprising a rod piece having a base portion with a midsection and two ends, a side portion extending upward from each one of the two ends of the base portion and slanting inward toward the midsection to define a first and a second slanted side portion, respectively, a neck portion extending upward from the first slanted side portion, and a hook portion extending upward from the neck portion, the base portion is curved upward at the midsection toward the hook portion, in which the second slanted side portion has a free end not integrally attached to the neck portion so that a door is disposed between the first and second slanted side portions wherein the garment hanger is adapted to provide flexibility in positioning garments thereon.

2. The hanger of claim 1 in which the free end is rounded.

3. A garment hanger comprising a rod piece having a base portion with a midsection and two ends, a side portion extending upward from each one of the two ends of the base portion and slanting inward toward the midsection to define a first and a second slanted side portion, respectively, a neck portion extending upward from the first slanted side portion, a hook portion extending upward from the neck portion, in which the second slanted side portion has a free end not integrally attached to the neck portion so that a door is disposed between the first and second slanted side portions, and a latch removably attaching the free end to the neck portion or the first slanted side portion, wherein the garment hanger is adapted to provide flexibility in positioning garments thereon.

4. The hanger of claim 1 in which the base portion is attached to the first and second slanted side portions with a bridge piece to provide flexibility between the base portion and the first and second slanted side portions.

5. The hanger of claim 1 in which an extension is disposed between at least one of (i) the first slanted side portion and the base portion and (ii) the second slanted side portion and the base portion to provide structural support for the hanger.

6. The hanger of claim 3, in which the latch comprises a notch at the free end configured to snap-fit over the neck portion or the first slanted side portion.

7. The hanger of claim 3 in which the latch comprises a loop at the free end.

8. The hanger of claim 3 further comprising a detent mechanism on the neck portion for retaining the latch to the neck portion.

9. A garment hanger consisting essentially of a rod having a base portion with a midsection and two ends, a side portion extending upward from each one of the two ends of the base portion and slanting inward toward the midsection to define a first and a second slanted side portion, respectively, a neck portion extending upward from the first slanted side portion, and a hook portion extending the neck portion, in which the second slanted side portion has a free end that is detachable from the neck portion so that a door may be disposed between the first and second slanted side portions [whereby the hanger may be inserted through the neck of a garment by the second slanted side portion being inserted through] wherein the garment hanger is adapted to provide flexibility in positioning garments thereon.

10. A garment hanger consisting essentially of a rod having a base portion with a midsection and two ends, a side portion extending upward from each one of the two ends and slanting inward toward the midsection to define a first and a second slanted side portion, respectively, a neck portion extending upward from the first slanted side portion, and a hook portion extending upward from the neck portion, in which the second slanted side portion has a free end not integrally formed with the hanger and a latch at the free end, the latch being configured to attach the free end to the rod at the neck portion or the first slanted side portion whereby when the latch is detached from the rod, the hanger may be inserted through the neck of a garment, and when the latch is attached to the rod, the hanger is adapted for hanging the garment.

11. The hanger of claim 9 in which the base portion is curved upward at the midsection toward the hook portion.

12. The garment hanger of claim 1 adapted for conveniently hanging pants in that a pair of pants may be slid through the door toward the first slanted side portion to rest on the base portion without having to thread the pair of pants through the hanger.

13. The garment hanger of claim 1 adapted for conveniently hanging top garments including shirts, sweaters and jackets, wherein the second slanted side portion of the garment hanger may be slid into the neck of the top garment to position the top garment to rest on the first and second slanted side portions, without having to unbutton or substantially stretch the neck of the top garment.

* * * * *